United States Patent [19]

Galle

[11] 4,375,242

[45] Mar. 1, 1983

[54] SEALED AND LUBRICATED ROCK BIT WITH AIR PROTECTED SEAL RING

[75] Inventor: Edward M. Galle, Friendswood, Tex.

[73] Assignee: Hughes Tool Company, Houston, Tex.

[21] Appl. No.: 177,292

[22] Filed: Aug. 11, 1980

[51] Int. Cl.[3] ..... E21B 10/18

[52] U.S. Cl. ..... 175/228; 175/339; 175/371

[58] Field of Search ..... 175/337, 339, 340, 371, 175/372, 228, 229

[56] References Cited

U.S. PATENT DOCUMENTS

| | | | |
|---|---|---|---|
| 3,244,459 | 4/1966 | Ortloff | 308/8.2 |
| 3,251,634 | 5/1966 | Dareing | 308/8.2 |
| 3,365,247 | 1/1968 | Ferrand | 308/8.2 |
| 3,463,270 | 8/1969 | Lundström et al. | 175/228 |
| 3,656,764 | 4/1972 | Robinson | 175/371 |
| 3,719,241 | 3/1973 | Bell | 175/228 |
| 3,921,735 | 11/1975 | Dysart | 175/337 |
| 3,952,815 | 4/1976 | Dysart | 175/374 |
| 4,098,358 | 7/1978 | Klima | 175/65 |
| 4,102,419 | 7/1978 | Klima | 175/371 |
| 4,172,562 | 10/1979 | Nederveen | 175/369 |
| 4,183,417 | 1/1980 | Levefelt | 175/339 |
| 4,287,957 | 9/1981 | Evans | 175/339 |
| 4,298,079 | 11/1981 | Norlande | 175/339 |

FOREIGN PATENT DOCUMENTS

| | | | |
|---|---|---|---|
| 1056075 | 4/1959 | Fed. Rep. of Germany | 175/339 |
| 2019921 | 11/1979 | United Kingdom . | |

*Primary Examiner*—William F. Pate, III

*Attorney, Agent, or Firm*—Robert A. Felsman

[57] ABSTRACT

An earth boring rock bit having a sealed bearing and pressure lubrication system for drilling the earth with air or gas as the circulating medium. An annular groove is formed in the vicinity of the seal and connected to the interior of the bit for cooling the ring and cleaning debris from the area of the ring. The air pressure inside the bit is utilized to bias a movable element in the system to urge lubricant to the bearing.

2 Claims, 2 Drawing Figures

SEALED AND LUBRICATED ROCK BIT WITH AIR PROTECTED SEAL RING

BACKGROUND OF THE INVENTION

This invention relates in general to rock bits used for earth boring, and in particular to improvements in the bearing lubrication and the sealing system for such bits.

The drilling of holes in the mining industry is accomplished with either a liquid or an air circulating medium. The liquid of air is utilized principally to cool the bit and flush earth cuttings from the bottom of the borehole to the surface ot the earth.

Rock bits used with a liquid drilling medium (called here "mud bits") commonly have a seal between each rotatable cutter and its supporting bearing shaft. A lubrication system provides lubricant in the bearing spaces and a flexible diaphram compensator system adjusts the pressure of the lubricant to the general level of the liquid or drilling mud on the exterior of the bit. The hydrostatic pressure of this exterior mud increases with depth and the flexible diaphram correspondingly causes increases in the pressure of the liquid in the lubrication system.

There are special problems encountered when air or gas is utilized as the circulating medium and attempts are made to seal the bearing of a mining bit. It is common to see abrasive wear of the seal, apparently caused by abrasive material such as sand around the bearing seal, promoting its early failure. In the shallow holes of mining applications there is little or no positive lubricant pressure maintained in the bearings. Moderately high rotational speeds and heavy weights are used. As a result of these and other reasons, bits used with air and gas drilling (called here "air bits") typically have roller bearings and ball bearings, with passage means from the interior of the bit to permit a portion of the air or gas to flow through the bearings. This has the effect of cooling the bearings and reducing the heat buildup in the bearing areas. Air bits do not utilize a seal since a seal between a cutter and shaft would impede the flow of cooling air through the bearing.

In recent years there have been apparent attempts to utilize seals in air bits. In U.S. Pat. No. 4,102,419, which issued to Frank J. Klima on July 25, 1978, there is shown a bit with a sealing ring in a bearing composed of antifriction elements, with passage means to introduce cooling air into the bearing. One passage introduces air to a spring loaded sealing ring to flush cuttings or other debris away from the seal.

In U.S. Pat. No. 4,183,417, which issued to Bert G. Levefelt on Jan. 15, 1980, there is shown a rock bit used in air drilling with a seal ring and a jet slot for the discharge of air between an annular surface of the leg and a seal ring.

In U.S. Pat. No. 4,172,502, which issued to Hans B. van Nederveen on Oct. 30, 1979, there is shown a rock bit with a locking ring having a seat for mounting a resilient sealing member with an annular slit connected to a channel in the bit to direct the flow of drilling mud radially out within the slit to prevent the penetration of drilling debris around the seal.

SUMMARY OF THE INVENTION

This invention is a rock bit which contains a journal or friction bearing and a pressure lubrication system to provide lubricant to the rotatable cutter and supporting shaft. A seal, preferably an O-ring, is provided between the cutter and shaft to retain lubricant within the bearing. An annular groove is formed between the cutter and the shaft adjacent but exterior of the annular seal for connection with the interior of the bit to provide air around the O-ring for cooling and protection from abrasive material. A lubricant pressure system has a movable element, one side of which communicates with the interior of the bit such that the pressure of the air biases the movable element and lubricant toward the bearing and maintains a positive pressure within the bearing.

Additional objects, features and advantages of the invention will become apparent in the following description.

DESCRIPTION OF THE PREFERRED EMBODIMENT

Figure 1:
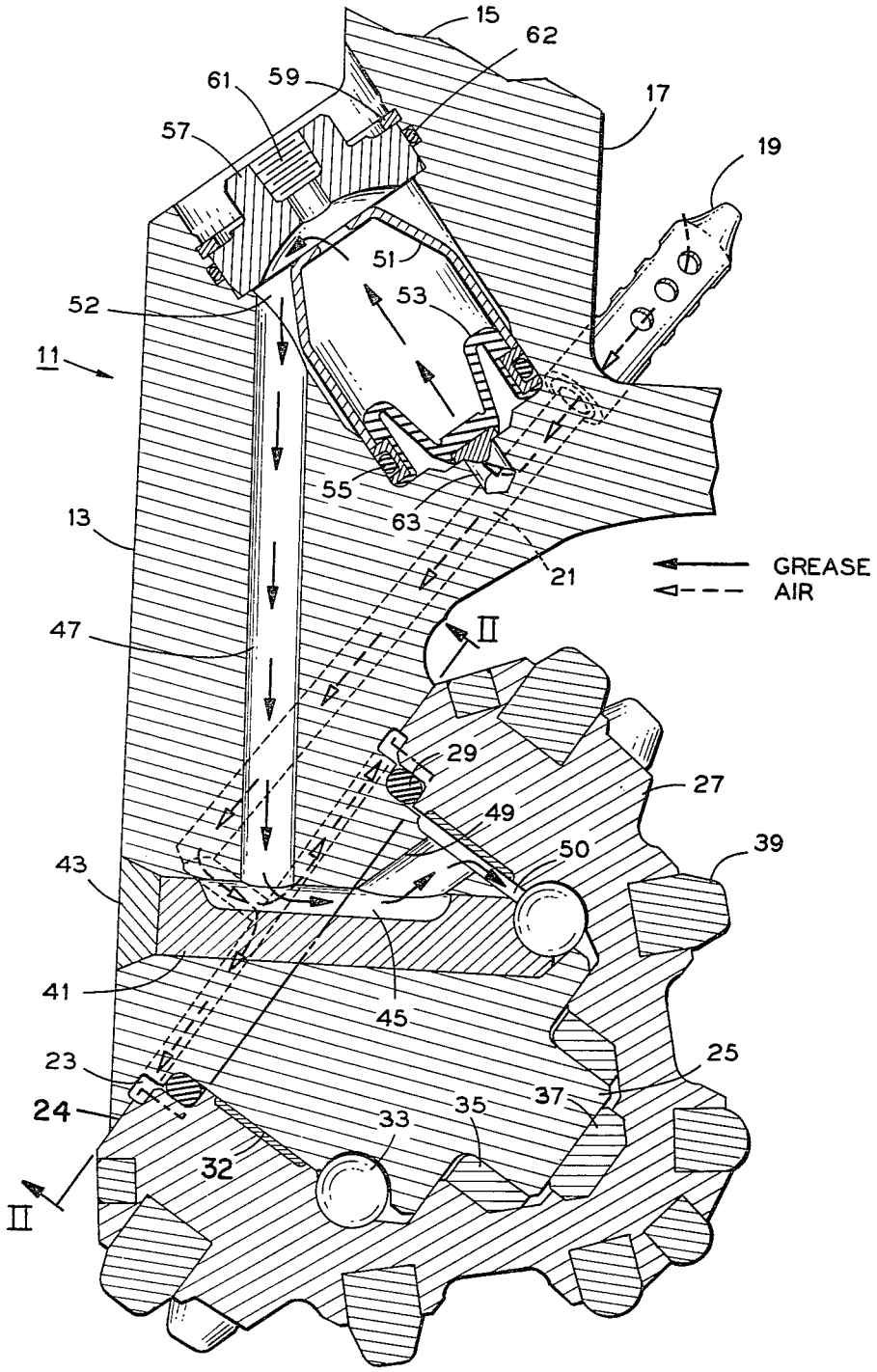
FIG. 1 is a side elevational view section showing the various features of the invention.

Referring initially to FIG. 1 of the drawing, the rock bit 11 has a body consisting generally of three legs 13, one of which is shown in FIG. 1 with the upper, threaded end broken away at 15. The threaded portion is used for attaching the drill bit to the drill string (not shown) which supports the bit, raises and lowers it in the hole, rotates it, and provides air or gas to a hollow interior 17. The air or gas is filtered through a perforated tube 19 and introduced to a gas passage 21 which extends obliquely through the leg and intersects an annular groove 23 formed between radial surfaces 24 located at the end of the bearing shaft 25 and cone or cutter 27. The annular groove 23 is adjacent to but exterior of the O-ring 29 used to seal lubricant in the bearing means and is formed exterior of the bearing shaft 25 and the interior of the cutter 27.

Figure 2:
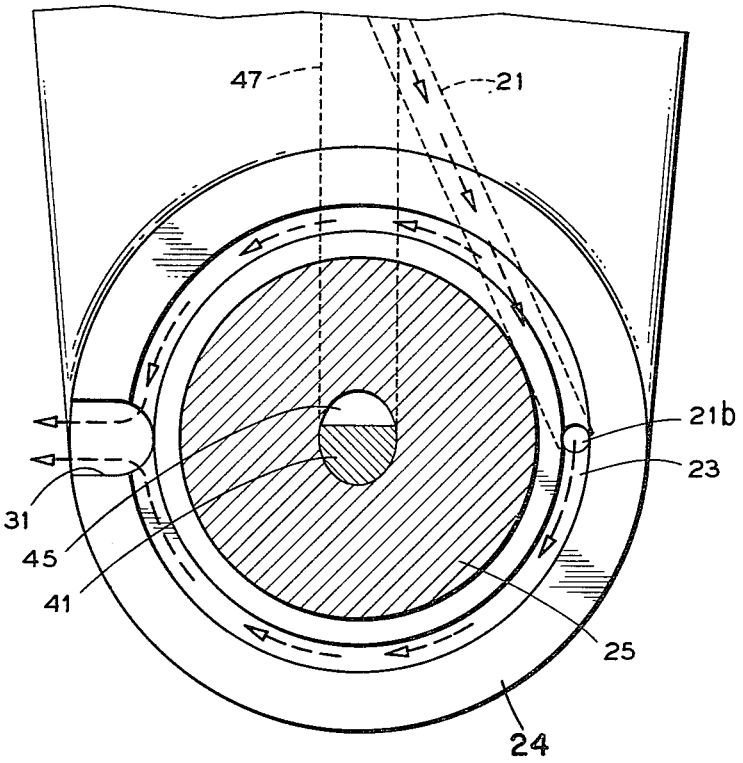
FIG. 2 is a cross sectional view as seen looking along the lines II—II of FIG. 1.

As best seen in FIG. 2 the gas passage 21 has an opening **21*b* located on one side of the bearing shaft. There is an exit port 31 formed on the opposite side of the bearing shaft such that air or gas flows along the length of the entire O-ring 29** for maximum cooling and protection from abrasive materials.

The bearing means as shown in FIG. 1 consists of a journal bearing 32, ball bearing 33, bushing 35 and thrust button 37. The cutter has a plurality of sintered tungsten carbide inserts 39 inserted in mating drilled holes within the cutter 27. The cutter 27 is retained rotatably on the bearing shaft 25 by means of the ball bearings 33 which were inserted during assembly through a hole drilled through the bearing shaft and subsequently filled with a ball plug 41 welded at 43. The ball plug has a passage 45 which receives a liquid lubricant from a lubricant passage 47 and discharges it through another passage 49 in the bearing into the various spaces 50 in the bearing means. The passage 47 leads to a lubricant chamber or cavity 52 which has a protector cup 51 and flexible diaphragm movable element 53 sealingly positioned in the chamber 52 by use of the O-ring and seal means 55. The cup 51 and diaphragm 53 are held in place by a retainer cap 57 and snap ring 59, the cap being threaded at 61 for insertion of lubricant and ease of removal of the cap which is sealed at 62. A pressurized passage 63 leading to the air or gas passage 21 biases the flexible diaphragm 53 to urge lubricant from the chamber 52, through the lubricant passageway 47 and ultimately to the spaces 50 between the bearing means, thus maintaining a positive lubricant pressure within the bearing.

In operation, and during drilling of a hole, air or gas is pumped through the drill string to the hollow interior portion 17 of the drill bit. Air or gas is introduced through the tubular separator or screen 19, gas passageway 21 and ultimately to the annular groove 23. Air flows along the annular groove 23 and cools and protects the sealing O-ring 23 to increase the life of the O-ring. Simultaneously, the pressurized air is introduced through pressurized passageway 63 to bias the flexible diaphragm 53 and urge liquid lubricant through the lubricant passageway 47 to the bearing means. Hence, the bearing means are adequately lubricated with liquid lubricant, a positive lubricant pressure is maintained to prevent vaporization of lubricant at elevated temperatures which is also beneficial to the O-ring 29, while the metal around the O-ring and the O-ring itself are cooled by the flow of air or gas through the annular groove 23. Any abrasive material which finds its way into groove 23 by entering between the cutter 27 and the bit leg 13 will be immediately flushed out of groove 29 by the flow of air or gas through the groove, thus protecting the O-ring 23.

While the invention has been shown in only one of its forms, it should be apparent to those skilled in the art that it is not thus limited but is susceptible to various changes and modifications without departing from the spirit thereof.

I claim:

1. In an earth boring drill bit having a body with a hollow interior and a nozzle passage to direct air or gas against the bottom of the borehole, at least one leg with a depending shaft to support a bearing means, a rotatable cutter on the bearing means, and an annular seal between the cutter and shaft, the improvement which comprises:

lubrication means including a lubricant passage in the shaft to provide liquid lubricant to the bearing means interior of the annular seal;

a pressure system including a movable element in a chamber to urge liquid lubricant to the bearing means on the interior of the annular seal during drilling;

a pressurized passage extending between the chamber and the gas passage to bias the movable element to provide positive lubricant pressure in the bearing means;

an annular groove formed in a radial surface at the end of the shaft adjacent to and exterior of the annular seal with at least one exit port;

an air or gas passage extending from the annular groove to the interior of the bit to provide the flow of cooling gas to cool the region around the seal and to protect the seal from abrasive materials to lengthen its life and maintain lubrication of the bearing means;

said exit port and said air or gas passage intersecting the annular groove to create substantially even flow across the length of the groove to evenly cool the adjacent annular seal.

2. In an earth boring drill bit having a body with a hollow interior and a nozzle passage to direct air or gas against the bottom of the borehole, at lease one leg with a depending shaft to support a bearing means, a rotatable cutter on the bearing means, and an annular seal between the cutter and shaft, the improvement which comprises:

lubrication means including a lubricant passage in the shaft to provide liquid lubricant to the bearing means interior of the annular seal;

a pressure system including a movable element in a chamber to urge liquid lubricant to the bearing means on the interior of the annular seal during drilling;

an annular groove formed in a radial surface at the end the cutter and shaft adjacent to and exterior of the annular seal with one exit port;

a gas passage extending from an opening in the annular groove to the interior of the bit to provide the flow of cooling gas to cool the region around the seal and protect it from abrasive material;

a pressurizing passage extending between the chamber and the gas passage to bias the movable element to provide positive lubricant pressure in the bearing means;

said opening in the annular groove being opposite the exit port to divide the flow into two parts, each part to flow along one-half an exterior portion of the seal to cool it evenly and exclude abrasives around its periphery.

* * * * *